US008844745B2

(12) United States Patent
Peters et al.

(10) Patent No.: US 8,844,745 B2
(45) Date of Patent: Sep. 30, 2014

(54) DISPENSER WITH A WIDE LID-ACTIVATION BUTTON HAVING A STABILIZING RIB

(75) Inventors: Timothy James Peters, Neenah, WI (US); Ryan Leslie Fulscher, Neenah, WI (US); Robert Samuel Schlaupitz, New London, WI (US); Kieron H. Tse, Chicago, IL (US); James Wolford, Chicago, IL (US); Tyson Manullang, Chicago, IL (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 259 days.

(21) Appl. No.: 12/871,208

(22) Filed: Aug. 30, 2010

(65) Prior Publication Data

US 2012/0048858 A1 Mar. 1, 2012

(51) Int. Cl.

*B65D 43/26* (2006.01)
*B65D 43/16* (2006.01)
*B65D 43/22* (2006.01)

(52) U.S. Cl.

CPC .... *B65D 43/164* (2013.01); *B65D 2543/00759* (2013.01); *B65D 2543/00694* (2013.01); *B65D 43/26* (2013.01); *B65D 2543/00805* (2013.01); *B65D 43/22* (2013.01); *B65D 2543/00194* (2013.01); *B65D 2543/0049* (2013.01); *B65D 2543/00944* (2013.01); *B65D 2543/00296* (2013.01); *B65D 2543/00648* (2013.01)

USPC ..... 220/264; 220/254.1; 220/254.3; 220/254.5; 220/262; 220/263; 220/833; 220/836; 220/837; 206/233

(58) Field of Classification Search

USPC ..... 220/254.1, 254.3, 254.5, 260, 262, 263, 220/264, 810, 823, 833, 836, 837, 849; 206/233, 494, 812

See application file for complete search history.

(56) References Cited

U.S. PATENT DOCUMENTS

| | | | | |
|---|---|---|---|---|
| 2,840,266 | A | 6/1958 | Nelson | |
| 2,840,267 | A | 6/1958 | Nelson | |
| 3,819,043 | A | 6/1974 | Harrison | |
| 3,986,479 | A | 10/1976 | Bonk | |
| 4,535,912 | A | 8/1985 | Bonk | |
| 4,625,885 | A * | 12/1986 | Nichols | 220/214 |

(Continued)

FOREIGN PATENT DOCUMENTS

| | | |
|---|---|---|
| CA | 094568 D | 1/2002 |
| CA | 100453 D | 2/2004 |

(Continued)

*Primary Examiner* — Fenn Mathew
*Assistant Examiner* — Madison L Poos
(74) *Attorney, Agent, or Firm* — Kimberly-Clark Worldwide, Inc.

(57) ABSTRACT

A lid structure for use with a container for storing personal care products is disclosed. The lid structure includes a lid-activation button that when pressed allows the lid top to rotate about the lid base giving a consumer access to the contents of the container. Additionally, the lid-activation button functions so that the lid top is released independent of where the lid-activation button is pressed by the consumer. To create better and more consistent opening of the lid top portion, an inner longitudinal edge of the lid-activation button may be attached to the lid bottom via a living hinge that is formed integrally with the lid base. A strengthening rib is attached to the living hinge that keeps the main body side of the living hinge immobile and encourages the button side of the living hinge to flex when the lid-activation button is depressed.

19 Claims, 8 Drawing Sheets

(56) References Cited

U.S. PATENT DOCUMENTS

| | | | | |
|---|---|---|---|---|
| 5,699,912 | A * | 12/1997 | Ishikawa et al. | 206/494 |
| 5,785,179 | A | 7/1998 | Buczwinski et al. | |
| D414,637 | S | 10/1999 | Amundson et al. | |
| D442,081 | S | 5/2001 | Paul | |
| 6,394,298 | B1 | 5/2002 | Zaidman | |
| D461,403 | S | 8/2002 | Chomik et al. | |
| D465,685 | S | 11/2002 | Dellerman et al. | |
| 6,585,131 | B2 | 7/2003 | Huang et al. | |
| 6,592,004 | B2 | 7/2003 | Huang et al. | |
| D479,419 | S | 9/2003 | White et al. | |
| D479,420 | S | 9/2003 | White et al. | |
| 6,766,919 | B2 | 7/2004 | Huang et al. | |
| D498,623 | S | 11/2004 | Sams et al. | |
| 6,889,867 | B1 | 5/2005 | Smith | |
| 6,951,292 | B2 * | 10/2005 | Bando et al. | 220/254.5 |
| 7,063,245 | B2 | 6/2006 | Faulks et al. | |
| 7,204,389 | B2 | 4/2007 | Smith | |
| D545,097 | S | 6/2007 | Schlaupitz et al. | |
| 7,614,519 | B2 | 11/2009 | Krauth et al. | |
| 7,621,420 | B2 | 11/2009 | Bandoh et al. | |
| 2003/0113582 | A1 | 6/2003 | Litvinov et al. | |
| 2006/0151515 | A1 | 7/2006 | Hood et al. | |
| 2008/0179326 | A1 | 7/2008 | Krauth et al. | |
| 2009/0014459 | A1 | 1/2009 | Hood et al. | |
| 2010/0122985 | A1 | 5/2010 | Peters et al. | |

FOREIGN PATENT DOCUMENTS

| | | | |
|---|---|---|---|
| CA | 101375 D | | 3/2004 |
| CA | 101376 D | | 3/2004 |
| CA | 119905 D | | 4/2008 |
| CN | 3347847 D | | 1/2004 |
| EP | 0 953 313 | A1 | 11/1999 |
| EP | 1 000 577 | B1 | 3/2006 |
| EP | 590112.0007 | | 9/2006 |
| GB | 3 001 914 D | | 3/2002 |
| GB | 3 008 980 D | | 1/2003 |
| GB | 3 008 981 D | | 1/2003 |
| JP | 11-180460 | A | 7/1999 |
| JP | 2003-170949 | A | 6/2003 |
| JP | 2003-170950 | A | 6/2003 |
| JP | 2010-116199 | A | 5/2010 |
| KR | 300328462 D | | 7/2003 |
| WO | WO 24971-010 D | | 1/1993 |
| WO | WO 59619-001 D | | 4/2002 |
| WO | WO 63250-002 D | | 3/2003 |
| WO | WO 2005/023677 | A1 | 3/2005 |
| WO | WO 2007/144558 | A2 | 12/2007 |
| WO | WO 2009/078774 | A2 | 6/2009 |

* cited by examiner

DISPENSER WITH A WIDE LID-ACTIVATION BUTTON HAVING A STABILIZING RIB

BACKGROUND

There is a variety of storing and dispensing containers in the market, particularly those for storing and dispensing personal care products. Personal care products, particularly wipes, have been made from a variety of materials which can be dry or wet when used. Wet wipes can be moistened with a variety of suitable wiping solutions. Typically, wet wipes have been stacked in a container in either a folded or unfolded configuration. For example, containers of wet wipes have been available wherein each of the wet wipes stacked in the container has been arranged in a folded configuration such as a c-folded, z-folded or quarter-folded configuration as are well known to those skilled in the art. Sometimes the folded wet wipes have also been interfolded with the wet wipes immediately above and below in the stack of wet wipes. Wet wipes have also been placed in containers in the form of a continuous web of material which includes perforations to separate the individual wet wipes and which is wound into a roll. Such wet wipes have been used for baby wipes, hand wipes, household cleaning wipes, industrial wipes, and the like.

The conventional containers which contain wipes have typically been designed to be positioned on a flat surface such as a countertop, table, or the like. Such conventional packages have generally provided a plastic container, tub or package which provides a sealed environment for the wet wipes to ensure that they do not become dirty and/or overly dry. To access the wipes, many containers have an access lid that is opened by pressing a button on top of the container. Some of these conventional packages have been configured to provide one at a time dispensing of each wet wipe which can be accomplished using a single hand after the container has been opened. Such single handed, one at a time dispensing is particularly desirable because the other hand of the user or care giver is typically required to be simultaneously used for other functions. For example, when changing a diaper product on an infant, the care giver typically uses one hand to hold and maintain the infant in a desired position while the other hand is attempting to dispense a baby wipe to clean the infant. The care giver may not want to look away from the infant to open the container and access the wipes.

However, the dispensing of wipes from such conventional containers for wipes has not been completely satisfactory. For example, many conventional containers have small buttons that can be difficult for a consumer to press or find when not looking directly at the package. Additionally, there have been issues with the buttons not functioning properly if pressed away from the center of the button. Therefore, there is a need to provide a dispenser with a wider lid-activation button which allows consumers access to the wipes for easier dispensing, particularly in a pop-up wipes product format.

SUMMARY

A container for storing personal care articles comprising a lid structure attached to the container base is disclosed. The lid structure has a lid top portion connected to a lid base portion by at least one hinge, the lid top portion having a lid fastener mechanism extending from the opposing side of the hinge. The lid base portion having a dispensing aperture formed therethrough. Additionally, the lid structure has a lid-activation button with a button fastener mechanism along an inner edge of the button in communication with the lid fastener mechanism. The lid-activation button has a width that is at least as wide as the width of an arm of a human being to allow for easier single-hand opening.

To create better and more consistent opening of the lid top portion, an inner longitudinal edge of the lid-activation button may be attached to the lid bottom via a living hinge that is formed integrally with the lid base. The container minimizes button failure by providing a strengthening rib attached to the living hinge that keeps the main body side of the living hinge immobile and encourages the button side (the movable side) to flex at the living hinge. The outer edge of the lid-activation button then deflects downward causing the inner longitudinal edge to disengage from the lid latching mechanism and move away from the lid top portion. This causes the lid top portion to rotate away from the lid base portion and provide access to the dispensing partition of the container.

Ideally, the outer edge of the lid-activation button is deflected downward from an original position when the lid-activation button is depressed by a user at a force of between about 0.5 lb*f and about 4 lb*f to release a lid fastener mechanism from a button fastener mechanism and allow the lid top portion to rotate away from the bottom lid portion. When the user releases the lid-activation button it returns to an original position. In an exemplary embodiment, the user provides a force of between about 2 lb*f and about 4 lb*f without causing lid-activation button failure.

In exemplary embodiments, the lid-activation button extends the entire width of the lid structure. In other embodiments, the lid-activation button has a width greater than 52 mm. In still other embodiments, the lid-activation button has a width greater than 72 mm. In still other embodiments, the lid-activation button has a width greater than 105 mm.

In other embodiments, the lid-activation button is an integral portion of the lid structure connected to the lid base via a living hinge. The living hinge may have a width that is substantially equal to the width of the lid-activation button.

BRIEF DESCRIPTION

DETAILED DESCRIPTION

Figure 1:
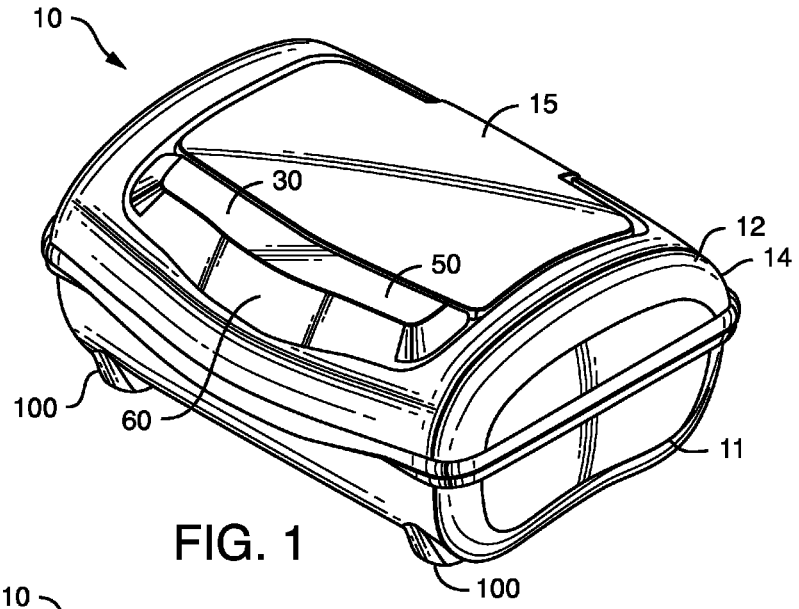
FIG. 1 illustrates a perspective view of an exemplary container for personal care articles.
Figure 2:
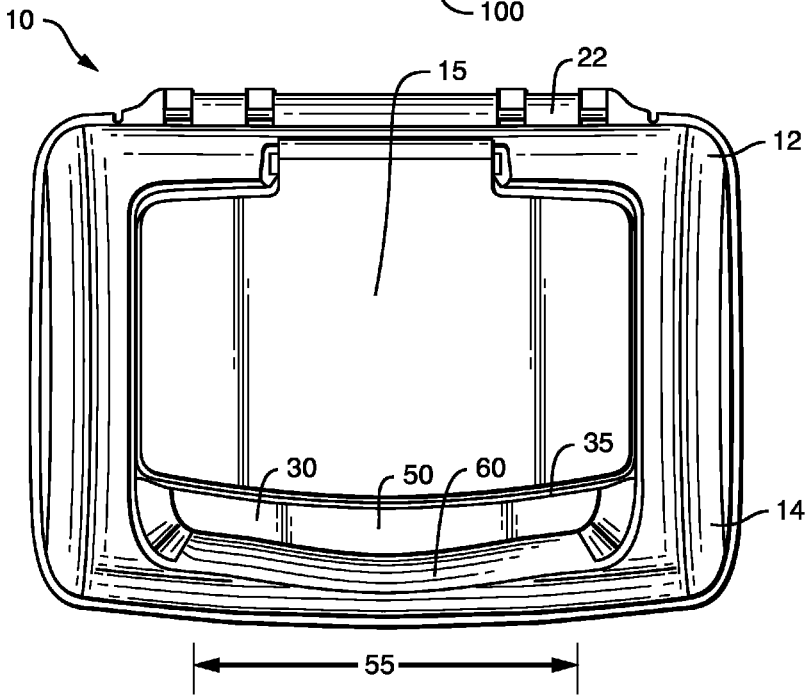
FIG. 2 illustrates a top view of the exemplary container for personal care articles depicted in FIG. 1.
Figure 3:
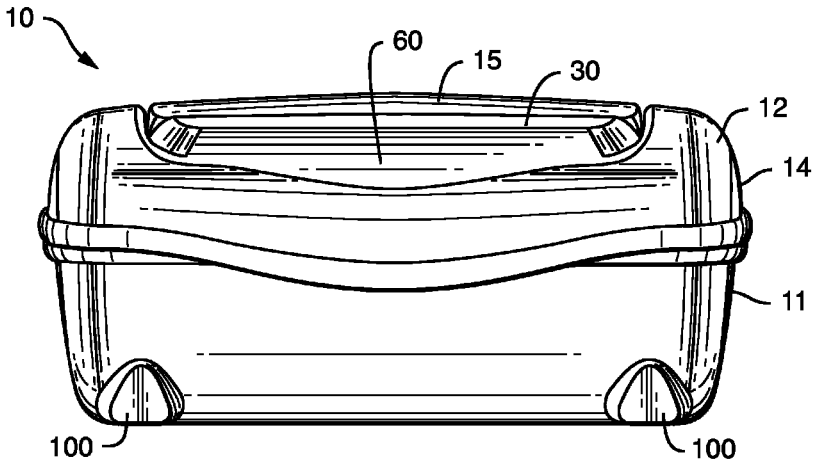
FIG. 3 illustrates a front view of the exemplary container for personal care articles depicted in FIG. 1.
Figure 4:
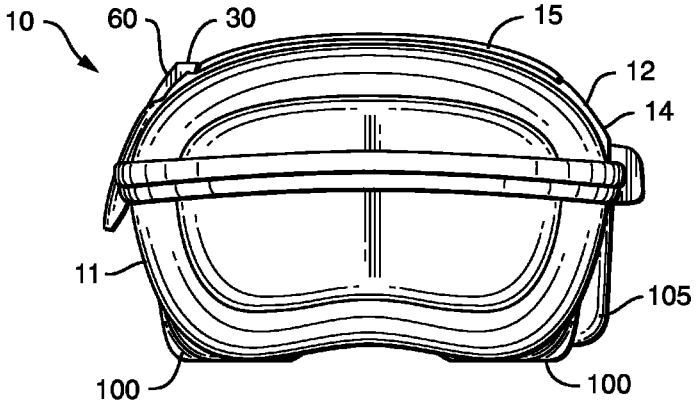
FIG. 4 illustrates a side view of the exemplary container for personal care articles depicted in FIG. 1.
Figure 5:
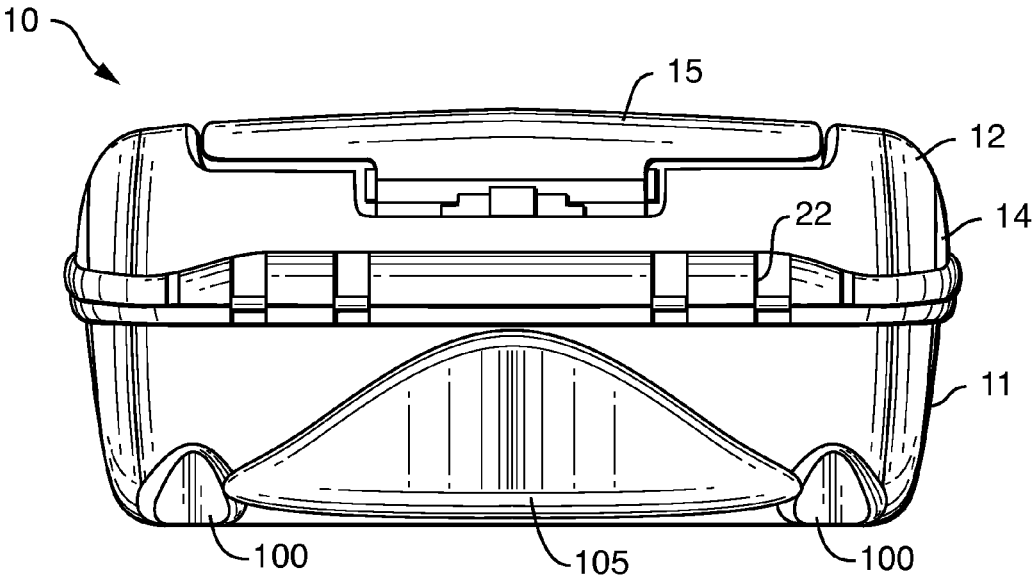
FIG. 5 illustrates a back view of the exemplary container for personal care articles depicted in FIG. 1.
Figure 6:
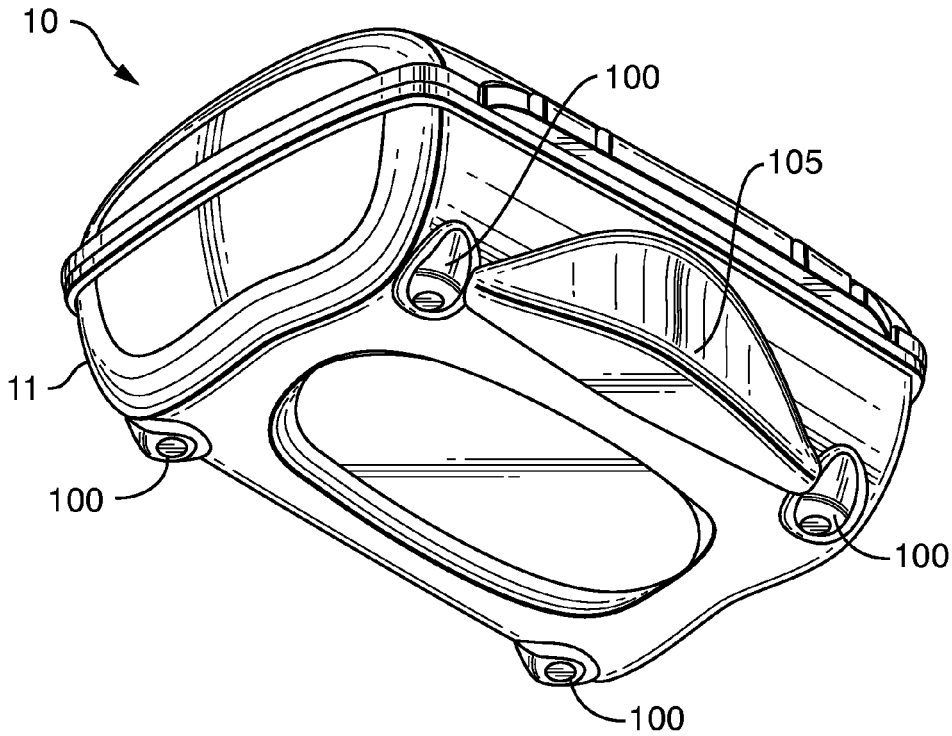
FIG. 6 illustrates a perspective view of the bottom of the exemplary container for personal care articles depicted in FIG. 1.
Figure 7:
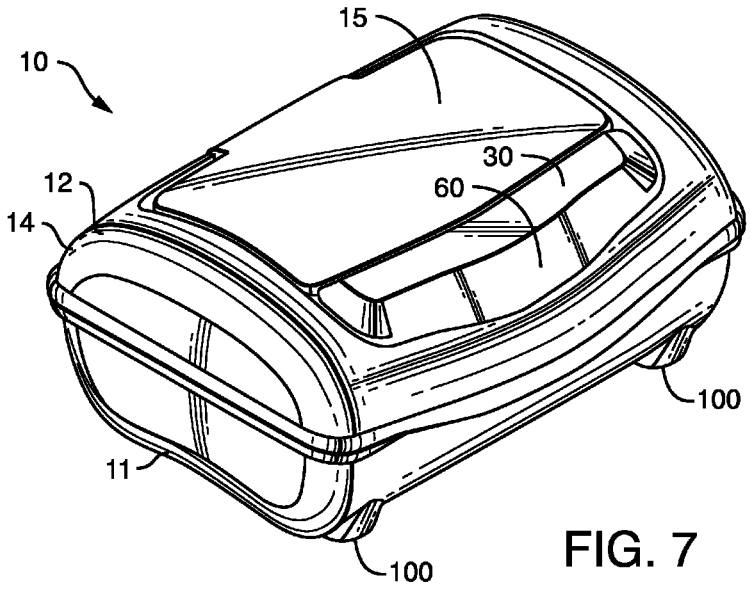
FIG. 7 illustrates a perspective view of the exemplary container for personal care articles depicted in FIG. 1.
Figure 8:
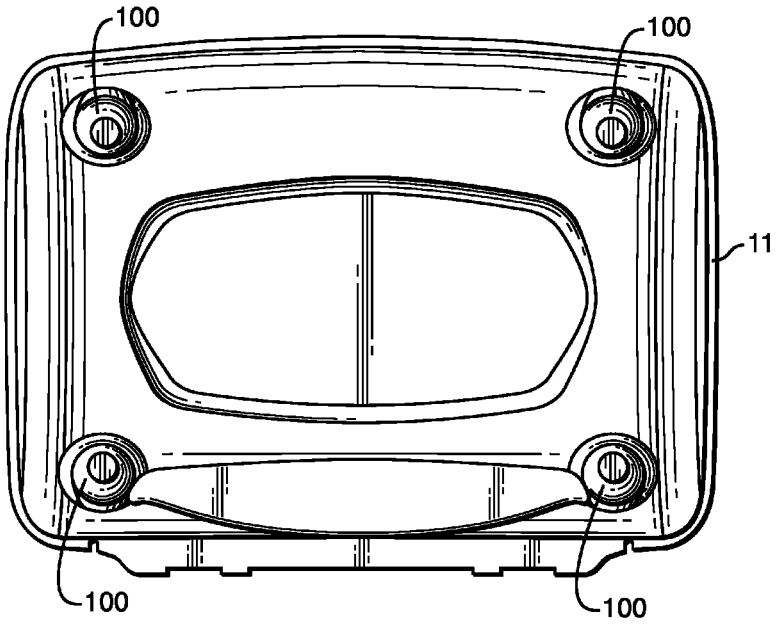
FIG. 8 illustrates a bottom view of the exemplary container for personal care articles depicted in FIG. 1.
Figure 9:
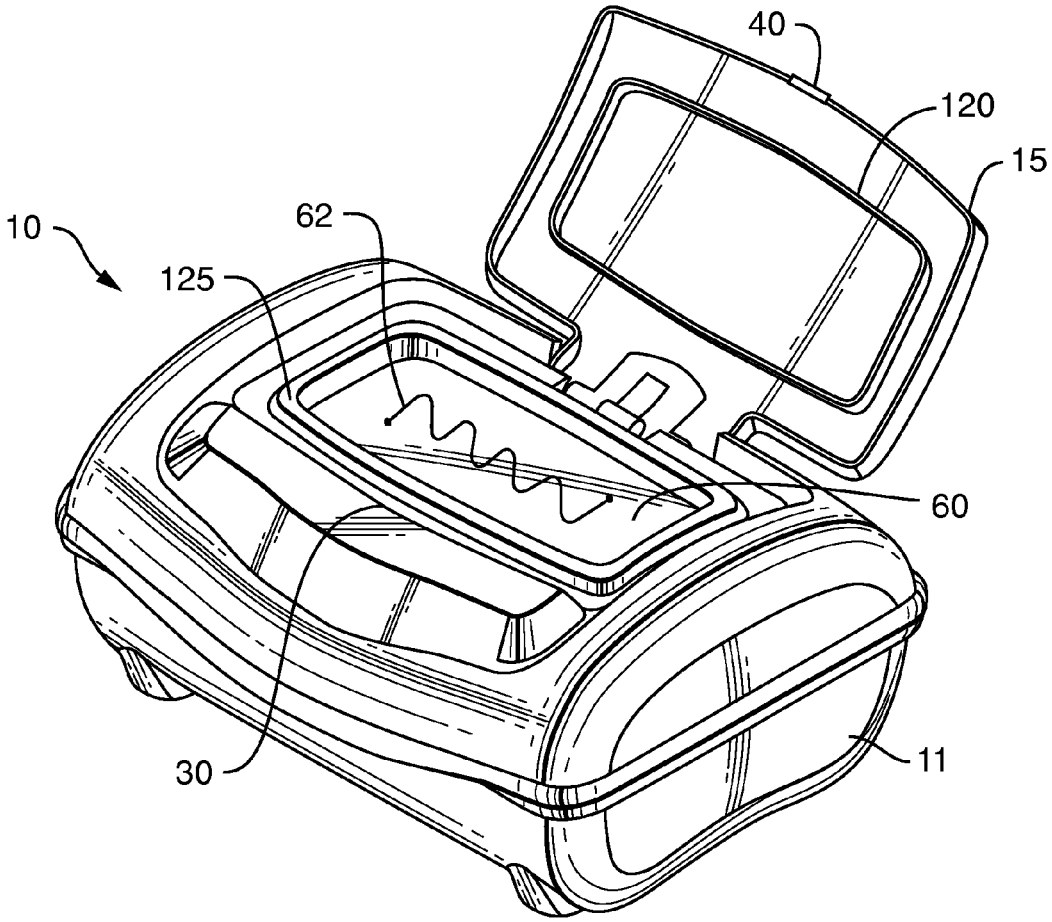
FIG. 9 illustrates a perspective view of the exemplary container for personal care articles depicted in FIG. 1 with the lid open.
Figure 10:
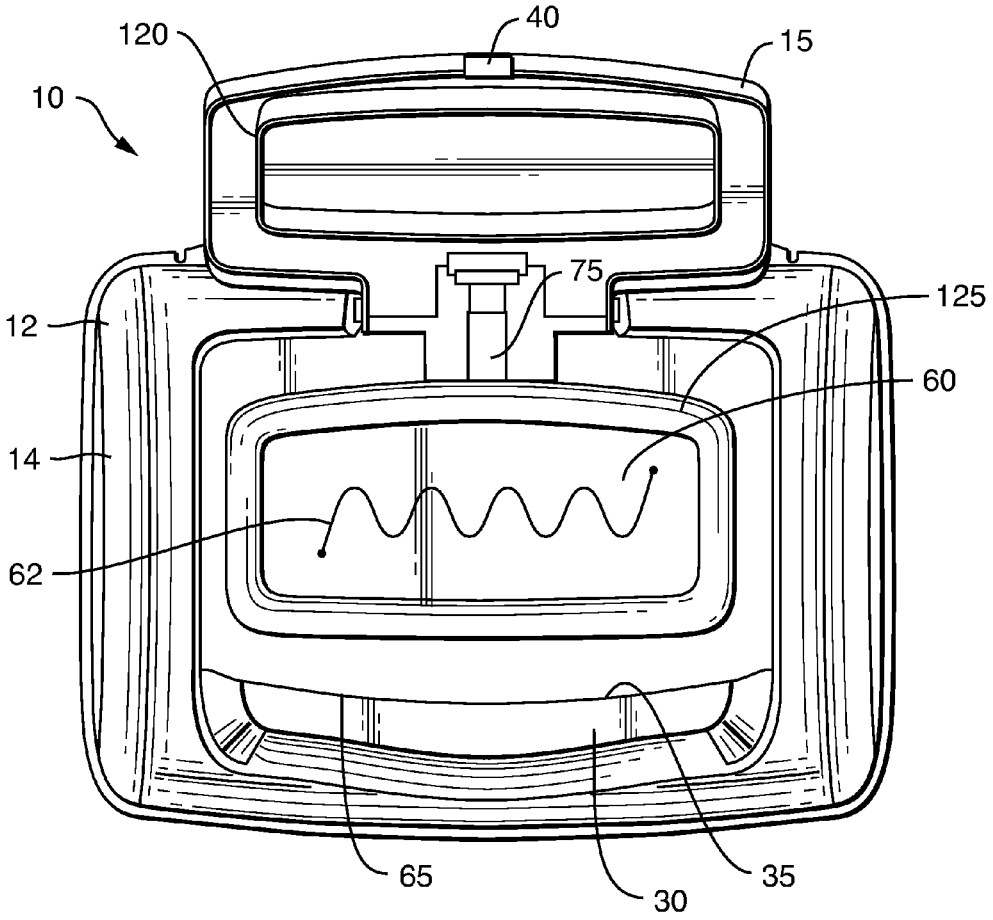
FIG. 10 illustrates a perspective view of the exemplary container for personal care articles depicted in FIG. 1 with the lid open.
Figure 11:
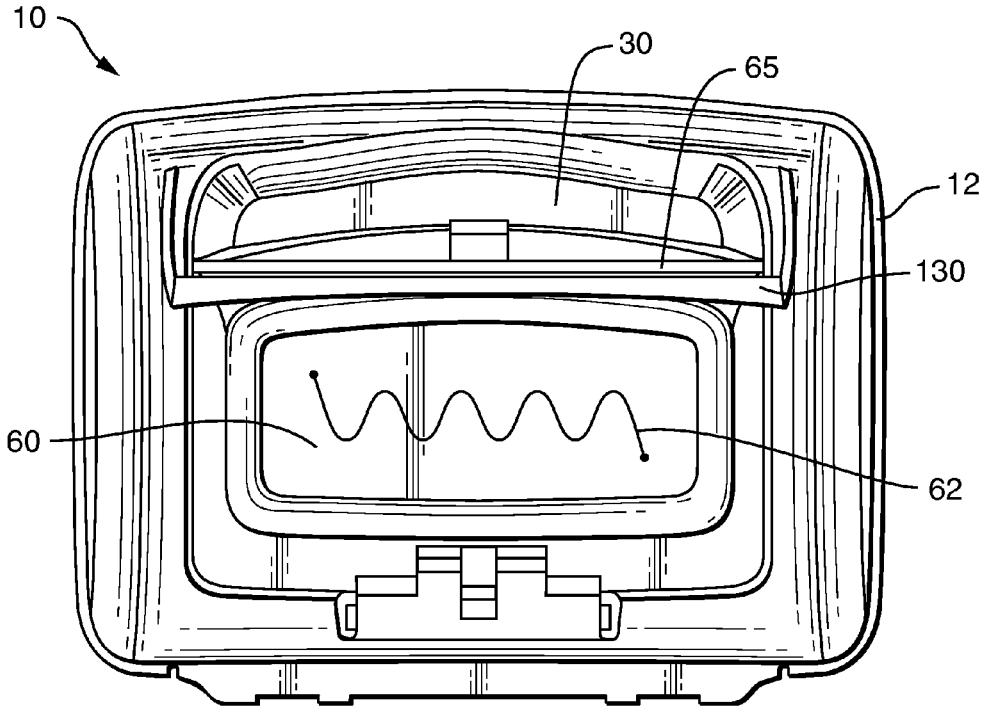
FIG. 11 illustrates a perspective view of the bottom of the lid base for the container for personal care articles.

Generally stated, a container for storing personal care products is disclosed. The container is attached to a lid structure that is attached to a container base. The lid structure includes a lid top that is connected by a hinge to a lid base. In exemplary embodiments, the lid structure includes a lid-activation button that, when pressed, allows the lid top to rotate about the lid base via a hinge giving a consumer access to contents of the container. The lid-activation button is wide enough to allow a consumer to easily make contact with the lid-activation button and cause the lid top to open. Additionally, the lid-activation button functions so that the lid top is released independent of where the lid-activation button is pressed by the consumer.

Ideally, the outer edge of the lid-activation button is deflected downward at least 7 mm from an original position when the lid-activation button is depressed by a user at a force of between about 0.5 lb*f and about 4 lb*f to release a lid fastener mechanism from a button fastener mechanism and allow the lid top portion to rotate away from the bottom lid portion. When the user releases the lid-activation button it returns to an original position.

Reference will now be made in detail to the presently preferred embodiments of the invention, one or more examples of which are illustrated in the drawings. Each example is provided by way of explanation and is not meant as a limitation. For example, features illustrated or described as part of one embodiment or figure can be used on another embodiment or figure to yield yet another embodiment. It is intended that the present disclosure include such modifications and variations.

As illustrated in FIGS. 1-11, a container for storing personal care products having a lid structure 12 and a container base 11. The lid structure and container base meet at a curved outer seam. However, the lid structure and container base have an internal rib that is straight to provide the necessary fit to prevent moisture loss. The container base 11 has front and back feet 100 to create a pedestal look on the counter. The four bottom feet of the container 10 are integrally spaced to allow the filled dispenser the ability to stand upright on its front panel for merchandising; prevent the dispenser from sliding backward when pressing the button without holding the dispenser; and make sufficient contact with a moving inclined conveyor to be conveyed up a ramp during the manufacturing process. In addition, the feet 100 in the front half of the container 10 are completely separate from the feet 100 in the rear half of the container 10 to allow the container 10 to sit on a curved surface (i.e. top of a toilet tank) with minimal or no rocking.

Additionally, the container base 11 has a projection 105 extending from the back of the container base 11. This projection 105 may align with a co-location bracket, such as the bracket described in U.S. patent application Ser. No. 12/569,303 hereby incorporated by reference, for horizontally hanging the container, and it increases the strength of the back wall to prevent collapse.

The lid top 15 is hingedly attached to a lid base 14 to allow a consumer access to contents of the container therethrough. A tension member 75 is positioned against the lid top and lid base at the hinge. The tension member 75 is formed by a band or strip of flexible rubber or plastic, such as silicone, and/or a metal spring. The end of the tension member 75 forces against the lid top 15 to urge apart the lid top 15 and lid base 14 when a consumer pushes the lid-activation button 30 to open the lid structure 12.

In exemplary embodiments, the personal care products stored in the container are wet wipes that are used for baby wipes, hand wipes, household cleaning wipes, industrial wipes, and the like. The lid structure 12 may be formed as an integral part of the container 10 or may be positioned over a lid base 14. In an exemplary embodiment, the lid base 14 is connected to a container base 11 by a hinge 22 to enable a second opening into the container 10. A consumer may then be able to, if desired, refill the container with additional wipes.

In an exemplary embodiment, the lid base 14 contains a pop-up style dispensing partition wherein a flexible, rubber-like material or sheet 60 having a slit or hole 62 through which individual wet wipes are removed from the container 10. Examples of flexible rubber-like materials used in the container of the present disclosure include thermoplastic elastomeric (TPE) materials that can be used to provide acceptable dispensing. Materials which can be employed include (but are not limited to): any of the family of styrenic-based TPE's (i.e. styrenic block copolymer compounds); styrenic-based TPE's containing rubber modifiers such as Kraton™, Santoprene™, or other rubber modifiers; specialty copolymers, such as ethylene-methyl acrylate copolymers (e.g. EMAC™ of the Eastman Chemical Company); thermoset rubbers; polyurethane; alloys; amides; engineering TPE's; olefinic-based; olefinic vulcanizates; polyester-based; polyurethane-based. One such material for the flexible, rubber-like sheet could be that manufactured by the GLS Corporation of McHenry, Ill., USA and known as resin #G2701. The G2701 material is one of the resins in the product family of TPEs. G2701 is a styrenic-based material and is in the family of Styrenic block copolymer compounds. Some particular properties of the G2701 can be: specific gravity of 0.90 g/cc (per ASTM D792); hardness (Shore A durometer) of 68 (ASTM D2240); and compression set of 24% at room temperature, 96% at 70° C. (per ASTM 395B). Another similar material is known as G2755 and also sold by GLS Corporation. In addition, a lubricant (e.g., wax) can be added to lower the coefficient of friction of the continuous slit which can benefit injection molding, wet wipes dispensing, and physical handling of the flexible orifice. The G2701 TPE resin with 0.25% wax additive sold by GLS Corporation and known as #LC217-189 can be used. Surrounding the slit 62 in the dispensing partition sheet 60 is a dispensing partition sealing bump.

To enable access to the wipes stored within the container, the lid structure 12 includes a lid-activation button 30 having an inner longitudinal edge 35. The lid-activation button 30 comprises a substantially planar top surface 50 with a peripheral outer edge, the substantially planar top surface adapted to be contacted by a user. The inner longitudinal edge 35 of the lid-activation button 30 extends downward from the top surface 50 and is connected to the lid base 14. In some exemplary embodiments, the flexible rubber-like material 60 extends up from the lid base 14 and connects the remainder of the peripheral outer edge of the lid-activation button 30 to the lid base 14 to effect a proper seal. The peripheral outer edge may have a slight upward curve at its outer edge to prevent the finger or hand from slipping from the lid-activation button once depressed. Once the lid-activation button 30 is pressed and released by a consumer, the flexible rubber-like material 60 helps to compel the lid-activation button 30 back to its original position.

After the lid-activation button 30 is pressed, the lid top 15 is released from the lid base allowing a user to access an opening into the container. The lid top 15 is secured in a closed position by a suitable lid latching mechanism 40 engaged with a button latching mechanism 80. In exemplary embodiments, the lid latching mechanism 40 includes a protrusion latch in the front edge of the lid top 15 that is engaged by a button latching mechanism 80 including an aperture catch on the inner longitudinal edge of the lid-activation button 30. In other exemplary embodiments, the lid latching mechanism 40 includes a protrusion latch in the front edge of the lid top that is engaged by a button latching mechanism 80 including a protrusion catch in the inner longitudinal edge 35 of the lid-activation button 30. In still other embodiments, the lid latching mechanism 40 includes an aperture catch in the front edge of the lid top 15 that is engaged by a button latching mechanism 80 including a protrusion latch on the inner longitudinal edge 35 of the lid-activation button 30.

In particular embodiments, the lid-activation button 30 is wide enough so that a consumer will be able to easily press or contact the lid-activation button 30. Many conventional dispensers have small lid-activation buttons designed to be pressed by a thumb or single finger to open the lid. The small buttons require precise contact by a consumer. For example, in some instances, care givers changing infants would need to look away from the infant and towards the dispenser to accurately open the lid. Infants could move or roll away from the care giver unexpectedly potentially causing harm to the infant. Other consumers, such as toddlers or the elderly, may lack the dexterity or strength to accurately open the lid.

The lid-activation button 30 of the present disclosure has a width 55 generally parallel to the rotational axis of the hinge enabling a consumer to open the container hands-free by utilizing a portion of his or her arm to easily open the lid top 15 and obtain access to the contents of the container. For example, a consumer could use the palm of his or her hand, his or her arm, or his or her elbow to press the lid-activation button 30 and open the lid top 15. This allows the consumer to easily open the lid of the container with less dexterity or without looking at the container. Thus, the care giver could easily reach to the container and open the lid without taking their eyes off of an infant and looking directly at the container.

In addition, a wider lid-activation button 30 may prevent the spread of bacteria onto the surface of the container. A care giver may acquire bacteria on their hand prior to use of the wipes in the container while changing diapers on an infant, using the restroom, or other activities that require use of a wipe. By allowing a consumer to press a wider lid-activation button with a different portion of his or her arm, the consumer does not pass any bacteria from their hand onto the lid of the container. Thus, the wider lid-activation button provides a potentially more sanitary way to access wipes in the container.

In an exemplary embodiment, the width 55 of the lid-activation button 30 extends the entire width of the container 10. In other embodiments, the lid-activation button 30 extends for a width 55 of at least 50% of the width of the lid-structure 12. In other embodiments, the lid-activation button 30 extends for a width 55 of at least 75% of the width of the lid-structure 12.

In other exemplary embodiments, the lid-activation button 30 extends for a width 55 that is as least as wide as the width of an arm of an average human being. Accordingly, the width must be at least the width of a target user of the dispenser. Therefore, the lid-activation button 30 extends for a width 55 of at least about 52 mm. In other embodiments, the lid-activation button 30 extends for a width 55 of at least about 72 mm. In still other embodiments, the lid-activation button 30 extends for a width 55 of at least about 105 mm.

The inner longitudinal edge 35 of the lid-activation button 30 is attached to the lid bottom via a living hinge 65 that is formed integrally with the lid base 14. Living hinges may be constructed from plastic and other materials and formed integrally between two members. A living hinge permits pivotable movement of one member in relation to another connected member. To facilitate the lid-activation button 30 functioning when it is pressed anywhere on the lid-activation button 30, the living hinge 65 has a certain width with respect to the width of the lid-activation button 30. In an exemplary embodiment, the living hinge 65 has the same width generally parallel to the rotational axis of the hinge as the lid-activation button 30.

Previous dispensers having lid-activation buttons 30 have been depressed at the sides or edges of the lid-activation buttons by consumers and would sometimes fail and not open. By increasing the width of the lid-activation button 30, one skilled in the art would expect to create additional failures as the potential areas of contact increase away from the center of the button.

However, the container described herein solves this potential issue by providing a strengthening rib 130 attached to the living hinge 65 that keeps the main body side of the living hinge 65 immobile which encourages the button side (the movable side) of the living hinge 65 to flex. The outer edge of the lid-activation button 30 then deflects downward and disengages from the lid latching mechanism and causes the lid to rotate. Therefore, the lid-activation button 30 may be pressed at any point along its entire width and still cause the lid top to rotate and allow access into the container. In one embodiment, the rigidity of the lid-activation button 30 increases towards the inner longitudinal edge 35. An increase in rigidity at the strengthening rib 130 causes the lid-activation button 30 to rotate more uniformly about the living hinge 65. Thus, the lid-activation button 30 may be pressed at any point along its width and still provide access into the container.

When it is desired to open the lid structure 12, the lid-activation button 30 is pressed. This causes the inner longitudinal edge 35 and top surface 50 of the lid-activation button 30 to rotate about the living hinge 65. As the lid-activation button 30 rotates, the latching mechanism 40 on the lid top 15 is released. Once the lid top 15 is released from the lid-activation button 30, the tension member 75 forces the lid top 15 away from the lid base 14 to enable a consumer to access the wipes. The lid top 15 can be reclosed by moving the latching mechanism 40 in communication with the lid-activation button to reseal the container.

As used herein, rigidity means a level of stiffness commonly associated with materials used to manufacture tubs containing wet wipes or parts thereof. Numerically, these materials typically have a flexural modulus (as measured in accordance with ASTM D790 "Standard Test Method for Flexural Properties of Unreinforced and Reinforced Plastics and Electrical Insulating Materials") of at least 100 Newtons per square millimeter. In particular embodiments, the lid-activation button has a flexural modulus of between about 1100 to about 1500 Newtons per square millimeter. For example, the strengthening rib of the lid-activation button 30 may be at least 1350 Newtons per square millimeter if the remainder of the container 10 is 15 Newtons per square millimeter.

Ideally, the rigidity of the lid structure 12 may be at least 10% greater at the strengthening rib 130 than the remainder of the container 10. More desirably, the lid structure 12 may be at least 25% greater at the strengthening rib 130 than the remainder of the container 10. Even more desirably, the rigidity of the lid structure 12 may be at least 50% greater at the strengthening rib 130 than the remainder of the container 10. To provide a more rigid strengthening rib 130 than the remainder of the container, the strengthening rib 130 may be formed with more rigid materials, formed with thicker sections of materials than the remainder of the container 10, or with ribs projecting downward into the interior of the container 10.

Figure 12:
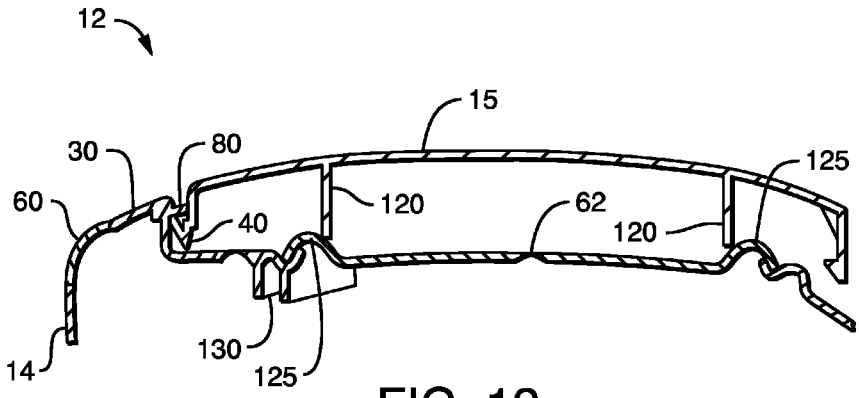
FIG. 12 illustrates a cross-sectional view of the lid of the dispenser for personal care articles.

Extending from the bottom of the lid top 15, there is a lid top moisture seal rib 120. The lid top moisture seal rib 120 contacts the dispensing partition sealing bump 125 of the lid base where the dispensing partition sealing bump 125 is not supported by the rigid polypropylene perimeter. This allows compression of the dispensing partition sealing bump 125 during closing, which allows latch over-travel. After the lid top 15 is closed, the over-travel is released when the consumer releases their finger and the lid top 15 is allowed to move slightly upward to its home position—while the full perimeter of the seal rib 120 still makes contact with the dispensing partition sealing bump 125, executing an effective moisture seal as illustrated in FIG. 12.

Ideally, the outer edge of the lid-activation button is deflected downward at least 7 mm from an original position when the lid-activation button is depressed to allow the downward movement of the outer edge of the button causing the inner edge of the wall of the lid-activation button to pull forward and away from the lid top releasing the lid top to open. Ideally, the outer edge of the lid-activation button is deflected downward between about 7 and about 15 mm to open the lid.

The strengthening rib also allows the outer third of the button to be depressed and cause the center of the lid-activation button to deflect enough to disengage from the lid base. Thus, a center of the outer edge of the lid-activation button is deflected downward from an original closed button position to an opening button position when an outer third portion the lid-activation button is depressed by a user. When a wider lid-activation button without a strengthening rib is depressed on the outer third of the button, the button will have a high failure rate and not work properly.

To ensure that the lid top will open, a user will provide a force of between about 0.5 lb*f and about 4 lb*f to release the lid fastener mechanism from the button fastener mechanism and allow the lid top portion to rotate away from the bottom lid portion. The lid-activation button will then return to the original position after the lid-activation button is released. Use of the strengthening rib and full button length living hinge allows this to occur since the strengthening rib keeps the main body side of the living hinge immobile and encourages the button side (the movable side) of the living hinge to flex. The controlled button flexing when the button is pressed anywhere along its length maximizes the transfer of lineal deflection downward to move the inner edge of the wall of the lid-activation button to pull forward and away from the lid top releasing the lid top to open.

Use of a lid-activation button without the strengthening rib will cause failure of button sticking or not opening when larger forces are placed on the button. When a user provides a force of greater than 2 lb*f, the button will start to stick and prevent proper functioning of the lid-activation button. Thus, the lid-activation button with strengthening rib described herein will provide proper functioning when large forces are used to depress the button.

The product, e.g., wipes or wet wipes, can be arranged in the dispenser in any manner which provides convenient and reliable one at a time dispensing and which assists the wipes in not becoming dirty and/or overly dry. For example, the wipes may be arranged in the dispenser or container as a plurality of individual sheets arranged in a stacked configuration to provide a stack of wipes which may or may not be individually folded. The wipes may be individual wipes which are folded in a c-fold, z-fold, quarter fold or other zigzag fold or interfolded or non-interfolded configurations as are known to those skilled in the art. The product may include a plurality of wipes stacked one on top of each other in a non-interfolded configuration, for "reach-in" dispensing. For such a non-interfolded wipe, each wipe is folded onto itself with no portion of another wipe being positioned between or underneath any portion of the folds of the adjacent wipe(s). These configurations for wipes, as well as those discussed herein, may be provided by means known to those skilled in the art.

Alternatively, the individual wipes can be interfolded or in other ways related such that the leading and trailing end edges of successive wipes in the stacked configuration overlap, for "pop-up" dispensing. In such a configuration, the leading end edge of the trailing wipe is loosened from the stack by the trailing end edge of the leading wipe as the leading wipe is removed by the user. The wipes can be interfolded to facilitate such dispensing by means known to those skilled in the art.

Yet alternatively, the wipes can be arranged in the dispenser as a continuous web of interconnected wipes which are folded in an accordion-like stacked configuration or a roll. The individual wipes can be connected together along lines of frangibility, such as lines of perforations, to ensure that the trailing wipe is in position for grasping by the user after the leading wipe is removed. For example, the wipes can be provided by a continuous web of material which has a series of lines of frangibility extending across the width of the web. The portion of the web of material between successive lines of frangibility provides each individual wipe. The lines of frangibility can be provided by means known to those skilled in the art such as perforations, indentations or cuts in the web of material. For example, the lines of frangibility or perforations can be provided in the web of material by passing the web of material between a die cutter roll and anvil roll. After the lines of frangibility have been incorporated into the web of material, the web can then be arranged in a stacked configuration for easy insertion into the dispenser during formation thereof.

The container can include any suitable number of individual wipes depending upon the desired packaging and end use. For example, the container can be configured to include a stack of wipes which can include at least about 5 wipes and desirably from about 8 to about 320 individual wipes, and more desirably from about 16 to about 80 wipes. The size and shape of the stack of wipes is dependent upon the size and shape of the container and vice versa.

Each wipe is generally rectangular in shape and defines a pair of opposite side edges and a pair of opposite end edges which can be referred to as a leading end edge and a trailing end edge. The leading end edge of each wet wipe is typically positioned in the dispenser under the dispensing orifice to be grasped by a user to facilitate a removal of the wipe from the container.

Materials suitable for the wipes of the present disclosure are well known to those skilled in the art. For wet wipes, these can be made from any material suitable for use as a moist wipe, including meltblown, coform, air-laid, bonded-carded web materials, hydroentangled materials, high wet-strength tissue and the like and can comprise synthetic or natural fibers, or combinations thereof. The wipes of the different aspects of the present disclosure can contain a liquid which can be any solution which can be absorbed into the wipes, thus making them "wet wipes." The liquid contained within the wet wipes can include any suitable components which provide the desired wiping properties. For example, the components can include water, emollients, surfactants, preservatives, chelating agents, pH buffers, fragrances, or combinations thereof. The liquid can also contain lotions, ointments and/or medicaments. The amount of liquid contained within each wet wipe can vary depending upon the type of material being used to provide the wet wipe, the type of liquid being used, the type of container being used to store the stack of wet wipes, and the desired end use of the wet wipe. Generally, each wet wipe can contain from about 15 to about 600 weight percent and desirably from about 200 to about 400 weight percent liquid based on the dry weight of the wipe for improved wiping.

Accordingly, the different aspects and features of the present disclosure can provide containers for wipes which, when compared to conventional containers for wipes, provide improved same container storage and dispensing. Such containers are particularly useful for dispensing baby wipes since the caregiver typically only has one hand free during the diapering process. Thus, the packages for wipes, e.g., wet wipes, of the present disclosure are reliably and easily opened by one hand of the user or care giver for improved convenience and personal hygiene. Additionally, the packages of the present disclosure can provide better, more consistent dispensing.

While the container useful for purposes of this present disclosure has been specifically illustrated in the figures, those skilled in the art will appreciate that many different container designs are possible, including canister style containers, without departing from the scope of the invention. It will be appreciated that the foregoing description, given for purposes of illustration, is not to be construed as limiting the scope of the present disclosure, which is defined by the following claims and all equivalents thereto.

EXAMPLES

Example 1

The performance of the lid-activation button can be measured more directly by using a tensile testing machine to contact the lid-activation button with a domed-shaped probe to measure the force required to actuate the release of the lid top. This simulates the use of one's finger to press the lid-activation button to release the lid top open to gain access to the wipes for dispensing. In general, the measurement involves placing a container to be tested underneath a probe which is mounted specially to a tensile tester. A container is placed in a fixture that holds it in a predetermined location relative to the probe. The tensile tester lowers the probe down to press the lid-activation button at a predetermined speed and measures the peak load, in grams, required to open the lid top. The location of where the lid-activation button can be contacted laterally can be varied. The lid-activation button of the tested container is 96 mm wide. The two points of interest for the test are at the center and at the outer third of the button (40 mm from center and 8 mm from the side of the button). To test buttons of different widths, the distance to measure the lid-activation performance at the outer third of the button should be conducted at ⅚ of the distance from the center of the button.

The tensile tester is a MTS Sintech 1/G with a MTS 100 Newton load cell. The software is TestWorks 4 for Windows. The dome-shaped probe used is approximately 5.375 inches long. The bottom portion of the probe, which contacts the sample to be tested, is dome-shaped and has a diameter of 0.5 inch.

When conducting the test, the container to be tested is securely placed in a fixture that can hold the container securely in a fixed position. The fixture includes scales and allows for adjustments for different sized containers. The probe is initially positioned such that it is approximately 4 inches above the center of the button. Upon the start of the test, the probe moves downward at a rate of 30 inches per minute for a distance of 3.9 inches. The probe then slows down to 1 inch per minute until it contacts the lid-activation button and registers a load of greater than 5 grams. At that point, the probe then moves downward at a rate of 50 inches per minute until a pre-determined extension is reached (7 mm for example). The test is repeated 9 additional times. The peak load reading and the load at disengagement from the tensile tester, expressed in grams or pounds of force, are averaged.

The disengagement point is determined by using a photoelectric eye that is connected to an external timer. When the lid top opens, it triggers the photoelectric eye and stops the timer. The time in seconds on the timer is then cross-referenced against the peak force data as a function of time as reported by TestWorks and the peak force at disengagement is recorded. The test is then repeated 10 times and the results averaged.

To determine the benefits of the strengthening rib, containers as described herein were tested that included a strengthening rib as well as containers that did not include the strengthening rib. Ten different containers of each were tested with the strengthening ribs and without at a set extension end point of 7 mm by contacting the probe at the center of the lid-activation button. Table 1 illustrates the force at lid top disengagement for the containers described therein.

TABLE 1

Exemplary Deflection and Force Values

| | Load at Disengagement (lb*f) | Extension at Disengagement (mm) |
|---|---|---|
| Strengthening rib present | 1.28 | 6.25 |
| Strengthening rib not present | 1.07 | 5.76 |

Table 1 illustrates that when pressing at the center of the lid-activation button the force to disengage the lid top is slightly increased with the presence of a strengthening rib.

To illustrate the importance of the strengthening rib to the functioning of the button, the test was also conducted by pushing on the button 40 mm to the side of center. Table 2 illustrates the force at lid top disengagement for this comparative container.

TABLE 2

Comparative Deflection and Force Values

| | Load at Disengagement (lb*f) | Extension at Disengagement (mm) | % Times lid top failed to release |
|---|---|---|---|
| Strengthening rib present | 2.58 | 8.62 | 10 |
| Strengthening rib not present | 1.99 | 8.69 | 60 |

Table 2 illustrates that not providing a strengthening rib creates a condition in which the main deck of the lid base deflects without releasing the lid top. With side pressing, the living hinge alone is not sufficient structural support to allow the lid-activation button to flexibly rotate and deflect far enough for the lid top to disengage.

Example 2

The rigidity of the strengthening rib portion can be measured more directly by using a tensile testing machine to contact the lid-activation button with a flat-shaped probe to measure the force required to cause a deflection in the tub. In general, the measurement involves placing a container to be tested underneath a probe which is mounted specially to a tensile tester. A container is placed in a fixture that holds it in a predetermined location relative to the probe. The tensile tester lowers the probe down to contact the lid structure at a predetermined speed and measures the peak load, in grams, required to cause a deflection of the material of 3 mm.

To determine the rigidity benefits of the strengthening rib, containers as described herein were tested using the same procedure as described above. Testing was completed as described in the above procedure. Containers including a strengthening rib and containers that did not include the strengthening rib were tested. Ten different containers of each were tested with the strengthening ribs and without at a set extension end point of 3 mm by contacting the probe at the center of the living hinge. Table 3 illustrates the rigidity at the strengthening rib for the container described therein.

TABLE 3

Comparative Rigidity Values

| | Average Peak Load (lb*f) |
|---|---|
| Strengthening rib not present | 1.48 |
| Strengthening rib present | 2.37 |

Table 3 illustrates that providing a strengthening rib creates a condition in which the lid base is 60% more rigid that a lid base without the strengthening rib. With side pressing, the living hinge alone is not sufficient structural support to allow the lid-activation button to flexibly rotate and deflect far enough for the lid top to disengage. Thus, providing a strengthening rib that creates higher rigidity provides a container that works correctly.

Other modifications and variations to the appended claims may be practiced by those of ordinary skill in the art, without departing from the spirit and scope as set forth in the appended claims. It is understood that features of the various examples may be interchanged in whole or part. The preceding description, given by way of example in order to enable one of ordinary skill in the art to practice the claimed invention, is not to be construed as limiting the scope of the invention, which is defined by the claims and all equivalents thereto.

The invention claimed is:

1. A container for storing personal care articles comprising:

a lid structure attached to a container base, the lid structure having a lid top portion and a lid base portion, the lid top portion having a hinge side and a fastener side opposite the hinge side, the lid top portion being connected to the lid base portion at the hinge side by at least one hinge, the lid top portion having a lid fastener mechanism extending from the fastener side of the lid top portion, the lid base portion having a dispensing partition with a dispensing aperture formed therethrough;

a lid-activation button having a button fastener mechanism along an outer edge of the lid-activation button in communication with the lid fastener mechanism;

a living hinge having a button side and a main body side formed integrally with the lid base portion;

a strengthening rib connected to the main body side of the living hinge, wherein the strengthening rib extends across a width of the lid structure;

wherein the lid-activation button is connected to the button side of the living hinge at an inner edge of the lid-activation button;

wherein when the lid-activation button is depressed, the main body side of the living hinge remains substantially immobile and the button side of the living hinge flexes to release the lid fastener mechanism from the button fastener mechanism and allow the lid top portion to rotate away from the lid base portion, wherein the dispensing partition and the lid-activation button are on opposite sides of the living hinge, further comprising a lid top moisture seal rib contacting a dispensing partition sealing bump to provide a moisture seal when the lid top portion is in a closed position.

2. The container of claim 1 wherein the container base has four equally spaced feet on a bottom of the container base.

3. The container of claim 1 wherein the living hinge has a width that is substantially equal to a width of the lid-activation button.

4. The container of claim 1 wherein the lid-activation button extends an entire width of the lid structure.

5. The container of claim 1 wherein the lid-activation button extends at least 75% of an entire width of the lid structure.

6. The container of claim 1 wherein a rigidity of the strengthening rib is at least 10% greater than a rigidity of the lid base portion.

7. The container of claim 6 wherein a rigidity of the strengthening rib is at least 50% greater than a rigidity of the lid base portion.

8. A container for storing personal care articles comprising:

a lid structure attached to a container base, the lid structure having a lid top portion and a lid base portion, the lid top portion having a hinge side and a fastener side opposite the hinge side, the lid top portion being connected to the lid base portion at the hinge side by at least one hinge, the lid top portion having a lid fastener mechanism extending from the fastener side of the lid top portion, the lid base portion having a dispensing partition with a dispensing aperture formed therethrough;

a lid-activation button having a button fastener mechanism along an outer edge of the lid-activation button in communication with the lid fastener mechanism;

a living hinge connected to the lid base portion via a strengthening rib, wherein the strengthening rib extends across a width of the lid structure;

wherein the lid-activation button comprises an integral portion of the lid structure connected via the living hinge at an inner edge of the lid-activation button;

wherein a width of the lid-activation button is greater than 52 mm;

wherein a center of the outer edge of the lid-activation button is deflected downward when an outer third portion of the lid-activation button is depressed by a user at a force of between about 0.5 lb*f and about 4 lb*f to release the lid fastener mechanism from the button fastener mechanism and allow the lid top portion to rotate away from the lid base portion;

wherein the lid-activation button returns to its original position after the lid-activation button is released by the user.

9. The container of claim 8 wherein the lid-activation button extends an entire width of the lid structure.

10. The container of claim 8 wherein the lid-activation button extends at least 75% of an entire width of the lid structure.

11. The container of claim 8 wherein the lid-activation button extends at least 50% of an entire width of the lid structure.

12. The container of claim 8 wherein a width of the lid-activation button is greater than 105 mm.

13. The container of claim 8 wherein a rigidity of the strengthening rib is at least 10% greater than a rigidity of the lid base portion.

14. The container of claim 8 wherein a rigidity of the strengthening rib is at least 50% greater than a rigidity of the lid base portion.

15. The container of claim 8 wherein the container base has four equally spaced feet on a bottom of the container base.

16. The container of claim 8 wherein the living hinge has a width that is substantially equal to a width of the lid-activation button.

17. The container of claim 8 further comprising a lid top moisture seal rib contacting a dispensing partition sealing bump to provide a moisture seal when the lid top portion is in a closed position.

18. The container of claim 8 wherein the center of the outer edge of the lid-activation button is deflected downward at least 7 mm when the lid-activation button is depressed by a user at a force of between about 2.0 lb*f and about 4 lb*f to release the lid fastener mechanism from the button fastener mechanism and allow the lid top portion to rotate away from the lid base portion.

19. The container of claim 8 wherein the dispensing partition and the lid-activation button are on opposite sides of the living hinge.

* * * * *